US005138931A

United States Patent [19]

Brookshire

[11] Patent Number: 5,138,931

[45] Date of Patent: Aug. 18, 1992

[54] REDUCED RECOIL GUN

[76] Inventor: Harold C. Brookshire, 2298 Carrollton Dr., Southaven, Miss. 38671

[21] Appl. No.: 728,738

[22] Filed: Jul. 12, 1991

[51] Int. Cl.[5] ..... F41A 3/28; F41A 5/18

[52] U.S. Cl. ..... 89/161; 89/191.01

[58] Field of Search ..... 42/10, 11; 89/161, 191.01

[56] References Cited

U.S. PATENT DOCUMENTS

| | | | |
|---|---|---|---|
| 886,211 | 4/1908 | Hino et al. | 89/161 |
| 2,128,243 | 8/1938 | Green | 89/14.5 |
| 3,020,662 | 2/1962 | Merkel | 42/11 |
| 3,580,132 | 5/1971 | Vartanian | 89/130 |
| 4,020,741 | 5/1977 | Junker | 89/185 |
| 4,028,994 | 6/1977 | Ferluga | 89/161 |
| 4,061,075 | 12/1977 | Smith | 89/132 |
| 4,088,057 | 5/1978 | Nasypany | 89/1.701 |

FOREIGN PATENT DOCUMENTS

| | | | |
|---|---|---|---|
| 260204 | 3/1988 | European Pat. Off. | 42/10 |
| 317095 | 4/1934 | Italy | 89/191.01 |

*Primary Examiner*—Stephen C. Bentley

*Attorney, Agent, or Firm*—Walker, McKenzie & Walker

[57] ABSTRACT

A gun comprising a frame, a barrel, and a slide. The barrel and the slide being slidably mounted to one another and to the frame for movement between a retracted position and an extended position; the barrel having a bore and having a gas port communicating with the bore for allowing gas to pass from the bore when the gun is fired; the gun having a chamber communicating with the gas port when the barrel and slide are in the retracted position and for receiving gas from the gas port when the gun is fired to cause the barrel and the slide to move from the retracted position to the extended position in a direction opposite the recoil of the gun when the gun is fired.

8 Claims, 3 Drawing Sheets

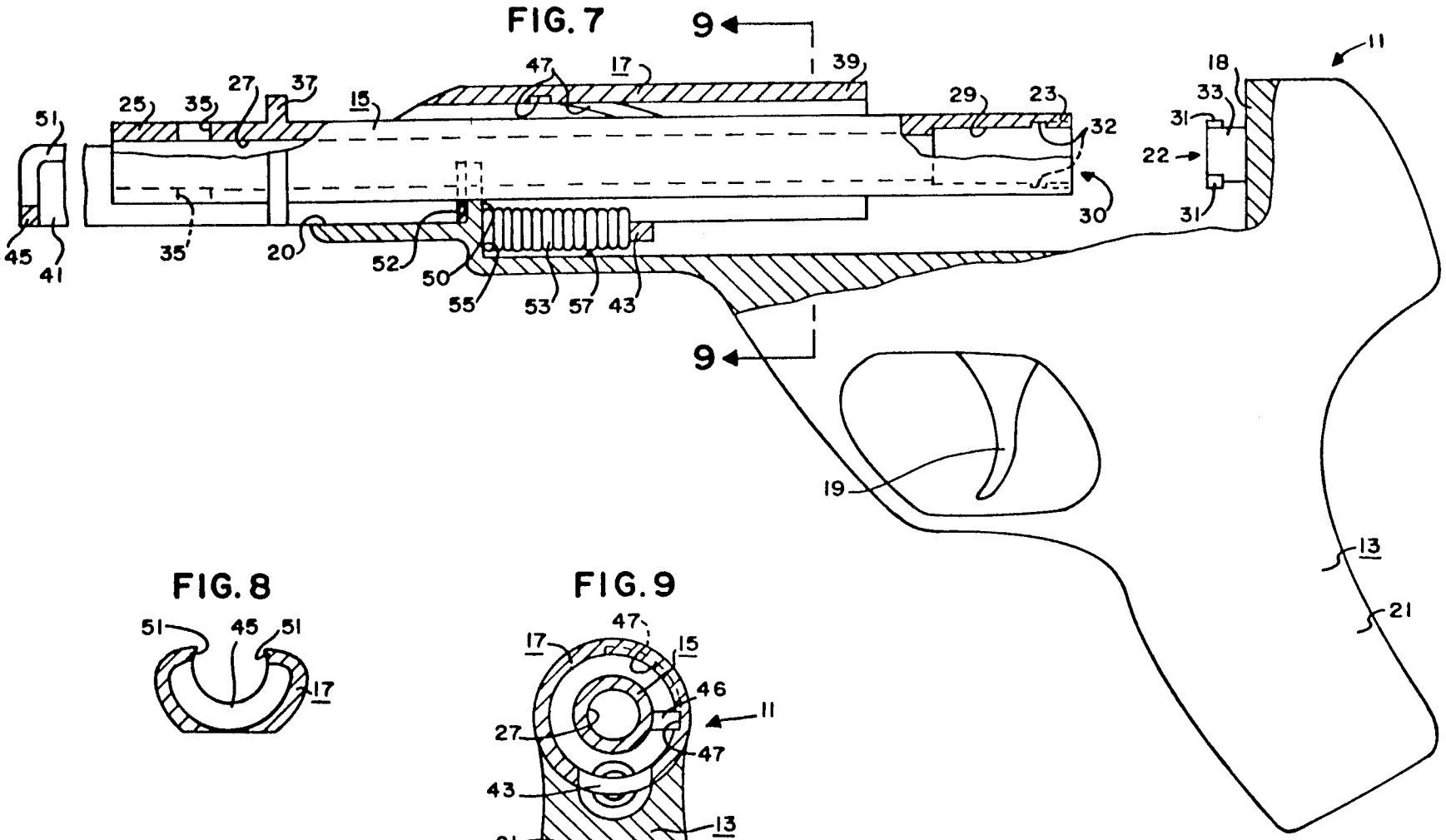
FIG. 7
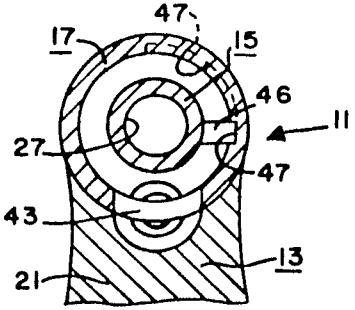
FIG. 9
FIG. 8

REDUCED RECOIL GUN

BACKGROUND OF THE INVENTION

1. Field of the Invention

The present invention relates, in general, to an improved gun including means for reducing the recoil thereof.

2. Description of the Related Art

A preliminary patentability search conducted in class 42, subclass 1V, and class 89, subclasses 14.3 and 161 disclosed the following patents:

Hino et al., U.S. Pat. No. 886,211, issued Apr. 28, 1908. Hino et al. discloses a pistol having a barrel slidably mounted in a stock and normally maintained in a rearward position by a spring. When the pistol is fired, the spring permits forward movement of the barrel and the shock of the recoil of the pistol is reduced.

Green, U.S. Pat. No. 2,128,243, issued Aug. 30, 1938, discloses a machine gun in which a baffle is mounted on the distal end of the barrel so that when a bullet fired from the gun leaves the barrel and enters the baffle, the gases following the bullet will impinge on the baffle and counteract the forces of recoil exerted on the gun.

Merkel, U.S. Pat. No. 3,020,662, issued Feb. 13, 1962, discloses a hunting rifle of the shortest possible over-all length in which the breech lock is fixed while the barrel is movable.

Vartanian, U.S. Pat. No. 3,580,132, issued May 25, 1971, discloses a buffer and delay mechanism for reducing the recoil force caused by reciprocation of a bolt assembly in a semiautomatic firearm, and for delaying the return of the bolt assembly from its retired position to its battery position.

Junker, U.S. Pat. No. 4,020,741, issued May 3, 1977, discloses a firearm including a housing having a detonation chamber and a projectile-discharge barrel. A displaceable piston is mounted at the discharge end of the barrel and is arranged to be acted upon and extended by combustion gases expelled from the barrel. Forward movement of the piston is transmitted to the housing in a manner tending to counteract recoil.

Ferluga, U.S. Pat. No. 4,028,994, issued Jun. 14, 1977, discloses a drop barrel action handgun in which the inertial of the rearwardly moving barrel is combined with the expanding gases from a discharging cartridge to effectively control the thigh pressures created at the time of discharge.

Smith, U.S. Pat. No. 4,061,075, issued Dec. 6, 1977, discloses an automatic weapon with a receiver, a breech block fixedly mounted in the receiver, a barrel reciprocable within the receiver, a spring biasing the barrel, and a gas cylinder chamber externally of the barrel and in communication therewith whereby upon firing of the weapon, the gases discharged from a cartridge ejected from the barrel, pass into the gas cylinder chamber means to thereby tension the spring.

Nasypany, U.S. Pat. No. 4,088,057, issued May 9, 1978, discloses a firearm recoil system that reduces the maximum recoil force felt by the shooter. The recoil force applied to the shooter's shoulder is interrupted by tapping off explosive gases produced by firing a cartridge and directing the gases into a gas cylinder to actuate a piston rearwardly and at the same time provide a forward force to the firearm opposite the rearward recoil movement of the firearm. The rearward piston movement is slowed down by compressing air trapped within the cylinder and then venting the compressed air so that the remaining recoil energy in the piston is gradually phased out.

None of the above patents disclose or suggest the present invention. More specifically, none of the above patents disclose or suggest a gun comprising a frame, a barrel, and a slide; the barrel and the slide being slidably mounted to one another and to the frame for movement between a retracted position and an extended position; the barrel having a bore and having gas port means communicating with the bore for allowing gas to pass from the bore when the gun is fired; the gun having chamber means communicating with the gas port means when the barrel and the slide are in the retracted position and for receiving gas from the gas port means when the gun is fired to cause the barrel and the slide to move from the retracted position to the extended position in a direction opposite the recoil of the gun when the gun is fired.

SUMMARY OF THE INVENTION

The present invention is directed toward providing an improved gun that has substantially less recoil than prior art guns of the same type and caliber or gauge. The gun of the present invention comprises, in general, a frame, a barrel, and a slide; the barrel and the slide being slidably mounted to one another and to the frame for movement between a retracted position and an extended position; the barrel having a bore and having gas port means communicating with the bore for allowing gas to pass from the bore when the gun is fired; the gun having chamber means communicating with the gas port means when the barrel and slide are in the retracted position and for receiving gas from the gas port means when the gun is fired to cause the barrel and the slide to move from the retracted position to the extended position in a direction opposite the recoil of the gun when the gun is fired.

BRIEF DESCRIPTION OF THE DRAWINGS

FIG. 7 is similar to FIG. 1 but with the slide and barrel thereof in a fully extended position.

FIG. 8 is a sectional view as taken on line 8—8 of FIG. 6.

FIG. 9 is a sectional view substantially as taken on line 9—9 of FIG. 7 with portions thereof omitted for clarity.

DESCRIPTION OF THE PREFERRED EMBODIMENT

Figures 1, 2, 3, 4, 5:
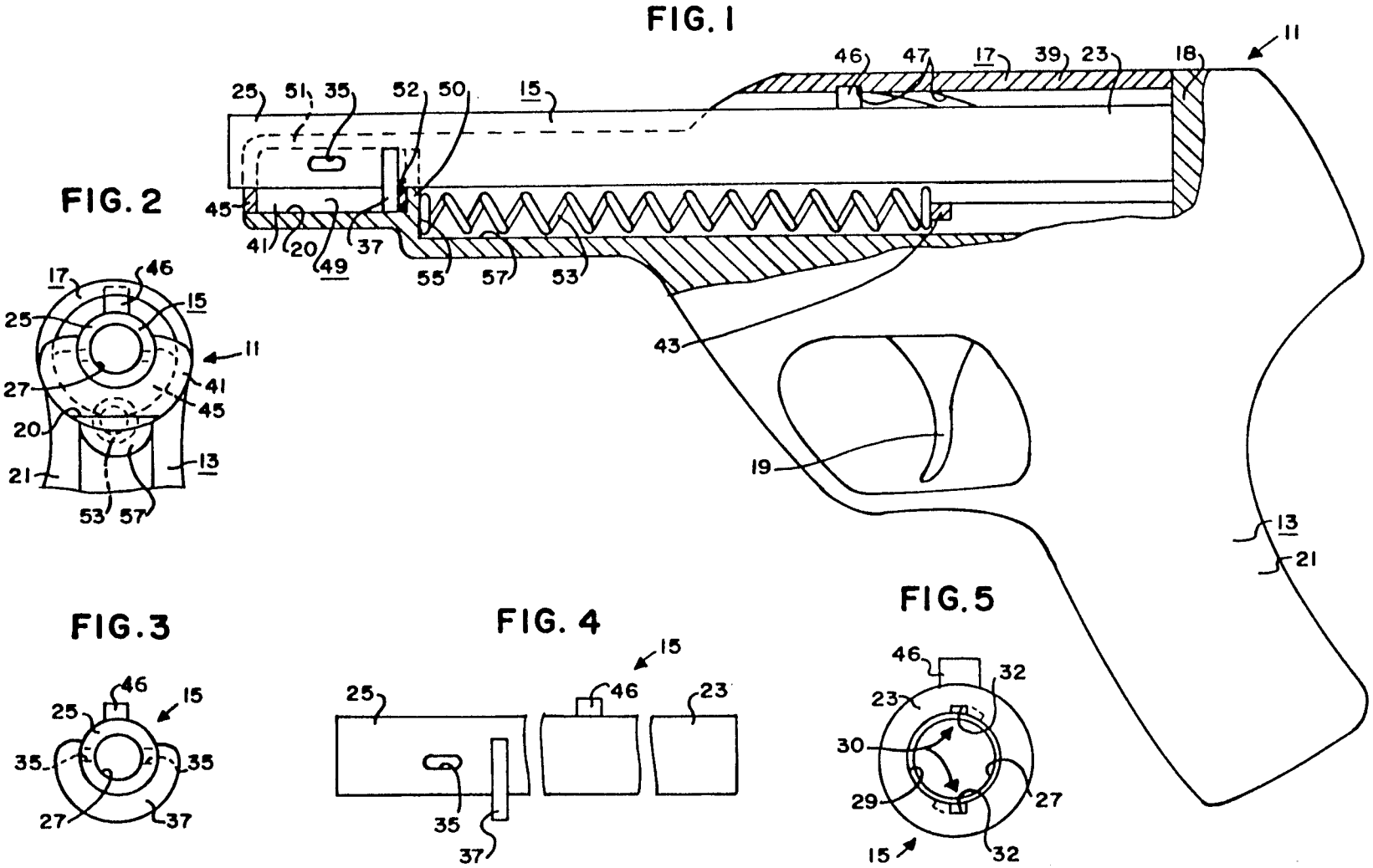
FIG. 1 is a side elevational view of the preferred embodiment of the improved gun of the present invention with portions thereof broken away to show certain internal structure.
FIG. 2 is a left end elevational view of a portion of FIG. 1.
FIG. 3 is a left end elevational view of the barrel of the gun of FIG. 1.
FIG. 4 is a side elevational view of the barrel of FIG. 3 with portions thereof broken away for clarity.
FIG. 5 is an enlarged right end elevational view of the barrel of FIGS. 3 and 4 with portions thereof omitted for clarity.

The preferred embodiment of the gun 11 of the present invention includes, in general, a frame 13, a barrel 15 and a slide 17.

The frame 13 includes a breech portion 18, a shelf portion 20 for reasons which will hereinafter become apparent, and a support means 21 to allow the gun 11 to be substantially fixedly supported relative to the user thereof. The support means 21 may consist of any typical structure well known to those skilled in the art. Thus, if the gun 11 is designed as an automatic pistol/-handgun as shown in the drawings, the support means may consist of a typical butt-type handle, etc., as will now be apparent to those skilled in the art. The frame 13 may be constructed in various specific manners, as will now be apparent to those skilled in the art, such as by being machined out of metal or the like. A firing means or mechanism 19 (only a portion of which is shown) is provided for allowing the user of the gun 11 to selectively fire the gun 11. The firing mechanism 19 may consist of a typical automatic handgun firing mechanism well known to those skilled in the art including cartridge magazine and feed means, firing pin, trigger and the like.

The barrel 15 has a first or butt end 23, a second or discharge end 25, and a bore 27 extending between the first and second ends 23, 25. An enlarged area 29 is provided in the bore 27 at the first end 23 of the barrel 15 for receiving a cartridge (not shown) in a manner as will now be apparent to those skilled in the art.

The gun preferably includes a lock means for selectively locking the first end 23 of the barrel 15 to the breech portion 18 of the frame 13. The lock means may include a first lock means 22 provided in or at the breech portion 18 adjacent the firing pin (not shown) of the firing mechanism 19 and a second lock means 30 provided in or on the first end 23 of the barrel 15 for coacting with the first lock means 22 to selectively lock the barrel 15 to the frame 13 with the first end 23 of the barrel 15 held against or to the breech portion 18 of the frame 13. The first and second lock means 22, 30 preferably coact to lock the barrel 15 to the frame 13 when the first end 23 of the barrel 15 is held against or adjacent the breech portion 18 of the frame 13 and rotated in a first direction about its longitudinal axis and to unlock the barrel 15 from the frame 13 when the barrel 15 is rotated in an opposite, second direction about its longitudinal axis as will now be apparent to those skilled in the art. Thus, the first lock means 22 may include one or more lugs 31 (see, in general, FIG. 7) and the second lock means 30 may include one or more grooves 32 (see, in general, FIG. 5) for receiving the lugs 31 of the first lock means 22 as will now be apparent to those skilled in the art. The lugs 31 are preferably located on a bolt head 33 of the breech portion 18 of the frame 13 to secure the butt end 23 of the barrel 15 to the bolt head 33 in a manner and for reasons which will now be apparent to those skilled in the art.

Transverse apertures 35 ar preferably provided through the barrel 15 at a point between the first and second ends 23, 25 thereof and communicate with the bore 27 to define gas port means for allowing gas to exit the bore 27 when a cartridge is fired and the bullet passes the apertures 35 for reasons which will be hereinafter explained. The barrel 15 preferably includes a flange 37 located adjacent the apertures 35 for reasons which will hereinafter be explained.

Figure 6:
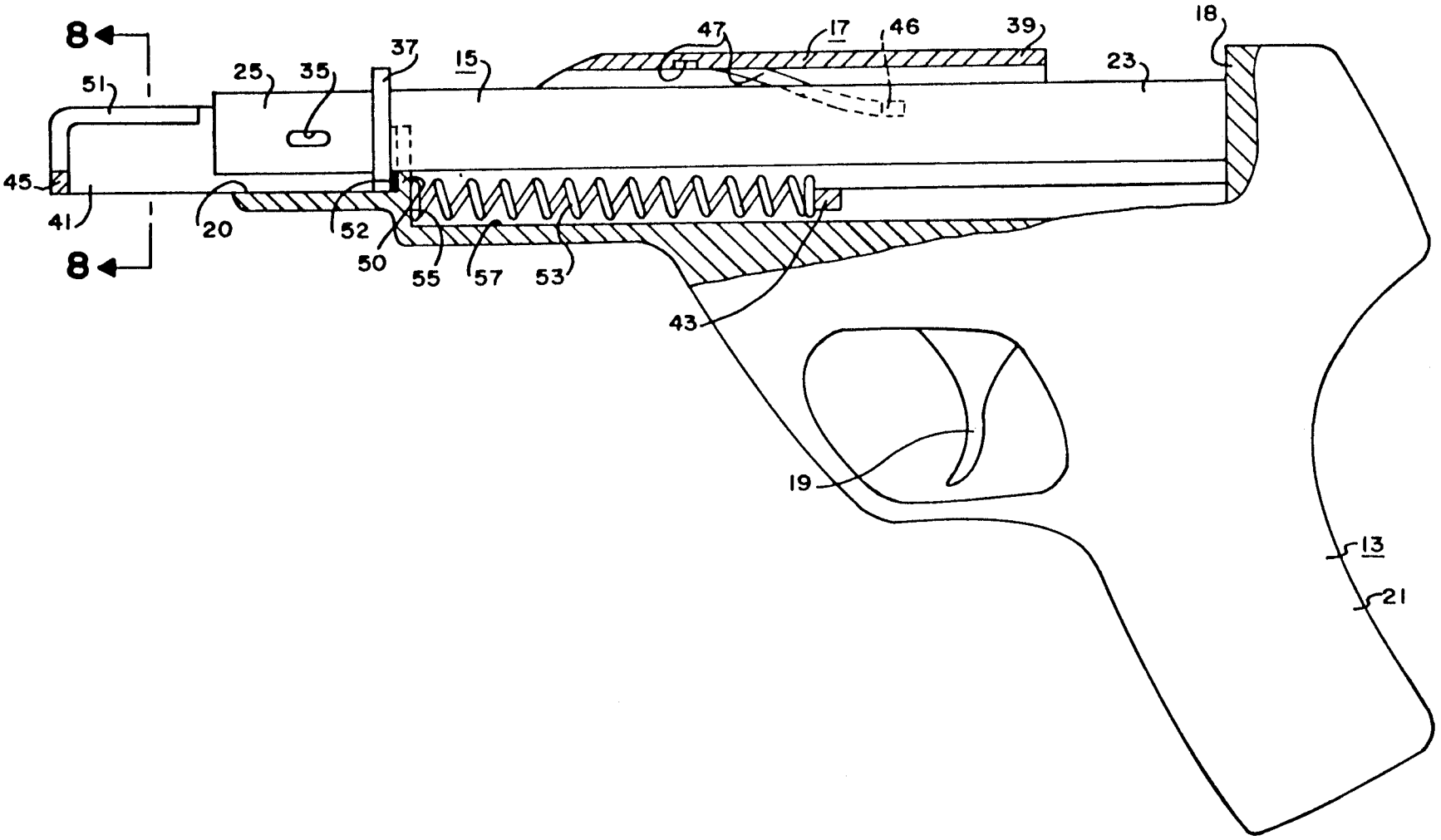
FIG. 6 is similar to FIG. 1 but with the slide thereof in a partially extended position.

The slide 17 is adapted to be mounted to the frame 13 and barrel 15 in such a manner that the slide 17 can move relative to both the frame 13 and the barrel 15 between a fully retracted position as shown in FIG. 1, a partially extended position as shown in FIG. 6, and a fully extended position on the frame 13 as shown in FIG. 7. The slide 17 has a first or butt end 39 and a second end 41. The bottom of the slide 17 may be substantially open except for a cross member 43 located substantially adjacent the first end 39 and an end member 45 located at the second end 41 thereof.

A cam means is preferably provided to cause the barrel 15 to rotate in the second direction about its longitudinal axis when the slide 17 moves from the fully retracted position to the partially extended position and to rotate in the first direction about its longitudinal axis when the slide 17 moves from the partially extended position to the fully retracted position. The cam means is preferably defined by a projection 46 provided on the exterior of the barrel 15 and a curved slot or groove 47 provided in the slide 17 for coacting with the projection 46 of the barrel 15 to cause the barrel 15 to rotate as the slide 17 moves between retracted and extended positions as will now be apparent to those skilled in the art.

The gun 11 is constructed so that the slide 17 and barrel 15 are securely coupled to the frame 13 in a manner which allows the barrel 15 and slide 17 to freely move relative to the frame 13 between the fully retracted and fully extended positions as will now be apparent to those skilled in the art.

The gun 11 includes a chamber means 49 communicating with the gas port means (i.e., with the apertures 35) when the barrel 15 and slide 17 are in the fully retracted position and for receiving gas from the gas port means when the gun 11 is fired to cause the barrel 15 and slide 17 to move from the retracted position to the extended position in a direction opposite the recoil of the gun 11 when the gun 11 is fired. The shelf portion 20 of the frame 13 is preferably located on the upper, distal end of the frame 13 in a location to coact with the flange 37 on the barrel 15 and the end member 45 of the slide 17 to define at least portions of the wall of the chamber means 49 and thus form the chamber means 49 therebetween when the slide 17 and barrel 15 are in the fully retracted positions shown in FIG. 1. The frame 13 preferably includes an upstanding shoulder or projection 50 located adjacent the end of the shelf portion 20 opposite the distal end thereof for coacting with the flange 37 to form a seal therebetween The slide 17 preferably includes an in-turned lip portion 51 located adjacent the end member 45 for coacting with the exterior of the barrel 15 to close the upper and forward ends of the chamber means 49 when the slide 17 and barrel 15 are in the retracted positions. A gasket or seal 52 of Teflon ® or the like is preferably provided between the flange 37 and the projection 50 to form a gas-tight seal therebetween when the slide 17 and barrel 15 are in the retracted positions as will now be apparent to those skilled in the art. The gun 11 is designed so that the apertures 35 communicate with the chamber means 49 when the slide 17 and barrel 15 are in the retracted positions. The flange 37 will also act as a scrapper to remove any carbon deposits that may be left on the shelf portion 20 from the gas as will now be apparent to those skilled in the art.

In operation, when a cartridge is fired, the bullet is expelled through the bore 27 by an explosion which creates gas in the bore 27 behind the bullet. As the bullet passes the apertures 35 and with the slide 17 and barrel 15 in the retracted positions, gas will pass from the bore 27 through the apertures 35 and into the fully closed and sealed chamber means 49. The gas will expand or explode within the chamber means 49 and cause the slide 17 to move forward (the slide 17 cannot, of course, move backwards when in the retracted position), opposite the direction of recoil of the gun 11 when the gun 11 is fired. As the slide 17 moves forward, the projection 46 on the barrel 15 and the groove 47 in the slide 17 will coact to define cam means for causing the barrel 15 to rotate about its longitudinal axis until the barrel 15 is unlocked from the frame 13. As the slide 17 continues moving forward, the projection 46 will encounter the rear end of the groove 47 and cause the barrel 15 to likewise move forward with the slide 17 opposite the direction of recoil of the gun 11 when the gun 11 is fired. It will be noted that the chamber means 49 will be "open" once the slide 17 starts moving forward and that the pressure of the gas behind the bullet will be dissipated when the bullet exits the barrel 15. However, the initial "explosion" of the gas through the apertures 35 into the closed chamber means 49 will create sufficient force or inertia to move the slide 17 and barrel 15 from the fully retracted, locked position as shown in FIG. 1 to the fully extended, unlocked position as shown in FIG. 7. Because the movement of the barrel 15 and slide 17 are opposite the direction of normal recoil of the gun 11 when the gun 11 is fired, the apparent or felt recoil of the gun 11 will be reduced. A spring 53 may be provided for forcing the slide 17 and barrel 15 from the fully extended positions to the fully retracted positions. The spring 53 is preferably located between the cross member 43 of the slide 17 and a stop 55 provided adjacent the distal end of the frame 13 as clearly shown in FIGS. 1, 6 and 7. An offset 57 may be formed in the frame 13 and the stop 55 may be defined by the distal end of the offset 57. Thus, movement of the slide 17 and barrel 15 from the fully retracted positions to the fully extended positions will compress the spring 53. The fully extended position may be defined when the spring 53 is fully compressed or the gun 11 may be designed so that the typical force causing the slide 17 and barrel 15 to move to the fully extended position is dissipated before the spring 53 is fully compressed as will now be apparent to those skilled in the art. In any event, once the spring 53 is compressed and the inertia causing the slide 17 and barrel 15 to move to the extended position is spent, the spring 53 will cause the barrel 15 and slide 17 to move back together to the partially extended position shown in FIG. 6 with the first end 23 of the barrel 15 at or adjacent to the breech portion 18 of the frame 13. Further uncoiling of the spring 53 will cause the slide 17 to continue moving toward the fully retracted position and the coaction of the projection 46 and groove 47 coact to define cam means for causing the barrel 15 to rotate to lock the barrel 15 to the frame 13 via the first and second lock means 22, 30 as will now be apparent to those skilled in the art.

By proper matching of the size of the apertures 35 (i.e., gas ports), weight of the barrel 15 and slide 17, and spring rate, the recoil of the gun 11 can be minimized as will now be apparent to those skilled in the art.

The specific construction of the various components may vary as will now be apparent to those skilled in the art. Thus, for example, the various components may be machined or otherwise formed out of metal or the like as will now be apparent to those skilled in the art.

Although the present invention has been described and illustrated with respect to a preferred embodiment and a preferred use therefor, it is not to be so limited since modifications and changes can be made therein which are within the full intended scope of the invention.

I claim:

1. A gun comprising a frame, a barrel, and a slide; said barrel and said slide being slidably mounted to one another and to said frame for movement between a retracted position and an extended position; said barrel having a bore and having gas port means communicating with said bore for allowing gas to pass from said bore when said gun is fired; said gun having chamber means communicating with said gas port means when said barrel and said slides are in said retracted position and for receiving gas from said gas port means when said gun is fired to cause said barrel and said slide to move from said retracted position to said extended position in a direction opposite the recoil of said gun when said gun is fired, said gun including means for rotating said barrel about its longitudinal axis after said gun is fired.

2. The gun of claim 1 in which said frame has a breech portion, in which said barrel has a first end and a second end, and in which is included lock means for locking said first end of said barrel to said breech portion of said frame when said barrel is in said retracted position.

3. A gun comprising:

a) a frame; said frame having a breech portion;

b) a barrel; said barrel having a bore and having gas port means communicating with said bore for allowing gas to pass from said bore when said gun is fired; said barrel having a first end and a second end;

c) a slide; said barrel and said slide being slidably mounted to one another and to said frame for movement between a retracted position and an extended position;

d) chamber means communicating with said gas port means when said barrel and said slide are in said retracted position and for receiving gas from said gas port means when said gun is fired to cause said barrel and said slide to move from said retracted position to said extended position in a direction opposite the recoil of said gun when said gun is fired;

e) lock means for locking said first end of said barrel to said breech portion of said frame when said barrel is in said retracted position; and f) cam means for rotating said barrel about its longitudinal axis when said slide moves between said retracted and extended positions, said lock means locking said barrel to said breech portion of said frame when said barrel is in said retracted position and rotated about its longitudinal axis in a first direction and unlocking said barrel from said breech portion of said frame when said barrel is in said retracted position and rotated about its longitudinal axis in a second direction.

4. The gun of claim 3 in which said chamber means is located adjacent said second end of said barrel when said barrel is in said retracted position.

5. The gun of claim 4 in which said barrel includes a flange located adjacent said second end thereof for defining at least a portion of the wall of said chamber means.

6. The gun of claim 5 in which said frame includes a shelf portion for defining at least a portion of the wall of said chamber means.

7. The gun of claim 6 in which said slide includes an end member and an in-turned lip portion for defining at least a portion of the wall of said chamber means.

8. A gun comprising:

a) a frame;

b) a barrel; said barrel having a bore and having gas port means communicating with said bore for allowing gas to pass from said bore when said gun is fired;

c) a slide; said barrel and said slide being slidably mounted to one another and to said frame for movement between a retracted position and an extended position;

d) chamber means communicating with said gas port means when said barrel and said slide are in said retracted position and for receiving gas from said gas port means when said gun is fired to cause said barrel and said slide to move from said retracted position to said extended position in a direction opposite the recoil of said gun when said gun is fired; and e) means for rotating said barrel about its longitudinal axis when said slide moves between said retracted and extended portions.

* * * * *